US011472591B2

(12) United States Patent
Oshino et al.

(10) Patent No.: US 11,472,591 B2
(45) Date of Patent: Oct. 18, 2022

(54) SYNTHETIC RESIN CONTAINER

(71) Applicant: YOSHINO KOGYOSHO CO., LTD., Tokyo (JP)

(72) Inventors: Tadayoshi Oshino, Tokyo (JP); Junichi Chiba, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 160 days.

(21) Appl. No.: 16/957,877

(22) PCT Filed: Nov. 7, 2018

(86) PCT No.: PCT/JP2018/041394
§ 371 (c)(1),
(2) Date: Jun. 25, 2020

(87) PCT Pub. No.: WO2019/130845
PCT Pub. Date: Jul. 4, 2019

(65) Prior Publication Data

US 2020/0339300 A1 Oct. 29, 2020

(30) Foreign Application Priority Data

Dec. 28, 2017 (JP) ..... JP2017-254564
Jan. 31, 2018 (JP) ..... JP2018-015848

(51) Int. Cl.
*B65D 83/00* (2006.01)
*B65D 1/02* (2006.01)
*B65D 1/40* (2006.01)

(52) U.S. Cl.
CPC ..... *B65D 1/0215* (2013.01); *B65D 1/0246* (2013.01); *B65D 1/40* (2013.01)

(58) Field of Classification Search
CPC ..... B65D 1/0215; B65D 1/0246; B65D 1/40
(Continued)

(56) References Cited

U.S. PATENT DOCUMENTS

2015/0008210 A1* 1/2015 Oshino ..... B65D 1/0276 215/373
2015/0298890 A1* 10/2015 Miyairi ..... B65D 83/0061 215/12.1

FOREIGN PATENT DOCUMENTS

CN 104755378 A 7/2015
JP 2000-062745 A 2/2000
(Continued)

OTHER PUBLICATIONS

Jun. 30, 2020 International Preliminary Reporton Patentability issued in International Patent Application No. PCT/JP2018/041394.
(Continued)

*Primary Examiner* — Don M Anderson
*Assistant Examiner* — Elizabeth J Volz
(74) *Attorney, Agent, or Firm* — Oliff PLC

(57) ABSTRACT

A synthetic resin container has an outer layer body and an inner layer body and formed by biaxial stretching blow molding. The synthetic resin container has a cylindrical mouth portion, a shoulder portion located below the mouth portion and having a diameter gradually increasing downward, a body portion being continuous with a lower end of the shoulder portion, and a bottom portion configured to close a lower end of the body portion. The mouth portion has an outside air introduction port configured to introduce outside air between the outer layer body and the inner layer body, and the shoulder portion has at least one shoulder rib forming a concave or convex shape and extending from the mouth portion side to the body portion side.

8 Claims, 5 Drawing Sheets

(58) Field of Classification Search
USPC ..... 220/62.11; 215/12.2, 378, 382, 902
See application file for complete search history.

(56) References Cited

FOREIGN PATENT DOCUMENTS

| | | | |
|---|---|---|---|
| JP | 2003-192031 | A | 7/2003 |
| JP | 2006-182389 | A | 7/2006 |
| JP | 2014-091537 | A | 5/2014 |
| JP | 2015-145249 | A | 8/2015 |
| JP | 2016-030630 | A | 3/2016 |
| JP | 2016-088534 | A | 5/2016 |
| JP | 2017-030773 | A | 2/2017 |
| JP | 2017-100747 | A | 6/2017 |
| JP | 2017-114555 | A | 6/2017 |
| JP | 2017-171368 | A | 9/2017 |
| JP | 2017-178434 | A | 10/2017 |
| JP | 2017-214127 | A | 12/2017 |

OTHER PUBLICATIONS

May 24, 2021 Office Action issued in Chinese Patent Application No. 201880083813.8.
Jul. 6, 2021 Office Action issued in Japanese Patent Application No. 2018-015848.
Jan. 29, 2019 International Search Report issued in International Patent Application No. PCT/JP2018/041394.
Dec. 20, 2021 Office Action issued in Chinese Patent Application No. 201880083813.8.
Dec. 21, 2021 Office Action issued in Japanese Patent Application No. 2018-015848.

* cited by examiner

SYNTHETIC RESIN CONTAINER

TECHNICAL FIELD

The present disclosure relates to a synthetic resin container.

BACKGROUND

As a container that contains foods such as food seasonings like soy source or beverages, cosmetics such as lotion, toiletries such as shampoo, rinse or liquid soap and the like as contents, a lamination separation container also referred to as a delamination container (delami container) is known.

Such a delamination container has a double container structure in which a volume-reducible and deformable inner layer body is disposed inside an outer layer body forming an outer shell of the container. A delamination container can be combined with a spout cap provided with a check vale so as to configure a squeeze type discharge container or combined with a pump so as to configure a container with a pump. In this case, contents contained in the inner layer body can be discharged to the outside by squeezing (pressing) a body portion of the outer layer body or by operating a pump. On the other hand, when the outside air is introduced between the inner layer body and the outer layer body from an outside air introduction port provided in a predetermined position, a shape of the outer shell can be maintained while the inner layer body is reduced in volume and deformed. As described above, in a delamination container, contents can be discharged without being replaced with the outside air in the inner layer body. Thus contact of the contents contained in the inner layer body with the outside air is prevented, and deterioration and change in quality of the contents can be suppressed.

The above described delamination container can be formed by biaxial stretch blow molding a preform that has a double structure in which an inner body is disposed inside an outer body (see, for example, Patent Literature 1 (PTL 1)).

CITATION LIST

Patent Literature

PTL 1: JP2017-178434 (A)

SUMMARY

Technical Problem

In the existing synthetic resin container disclosed in PTL 1, when an outside air introduction port is provided in a mouth portion, an air duct from the outside air introduction port to the body portion is not secured, and outside air may not be smoothly introduced to the body portion after contents are discharged.

It is an object of the present disclosure to provide a synthetic resin container that can easily secure an air duct from an outside air introduction port to a body portion.

Solution to Problem

A synthetic resin container according to an embodiment of the present disclosure is a synthetic resin container having an outer layer body and an inner layer body disposed inside the outer layer body and formed by biaxial stretching blow molding, the synthetic resin container having:

a cylindrical mouth portion;

a shoulder portion located below the mouth portion and having a diameter gradually increasing downward;

a body portion being continuous with a lower end of the shoulder portion; and a bottom portion configured to close a lower end of the body portion, wherein the mouth portion has an outside air introduction port configured to introduce outside air between the outer layer body and the inner layer body; and the shoulder portion has at least one shoulder rib configured to form a concave shape or a convex shape and extend from the mouth portion side to the body portion side.

In the synthetic resin container according to the present disclosure, a synthetic resin material forming the outer layer body and the inner layer body may be polyethylene terephthalate.

In the synthetic resin container according to the present disclosure, the at least one shoulder rib may extend along a radial direction of the shoulder portion in a top plan view.

In the synthetic resin container according to the present disclosure, the shoulder portion may be continuous with a lower end of the mouth portion.

In the synthetic resin container according to the present disclosure, the shoulder portion may form a curved shape having an inflection point where the upper side is concave and the lower side is convex in the longitudinal section.

Advantageous Effect

According to the present disclosure, a synthetic resin container that can easily secure an air duct from an outside air introduction port to a body portion can be provided.

DETAILED DESCRIPTION

A synthetic resin container according to an embodiment of the present disclosure will be described in more detail below with reference to the drawings.

Figure 1:
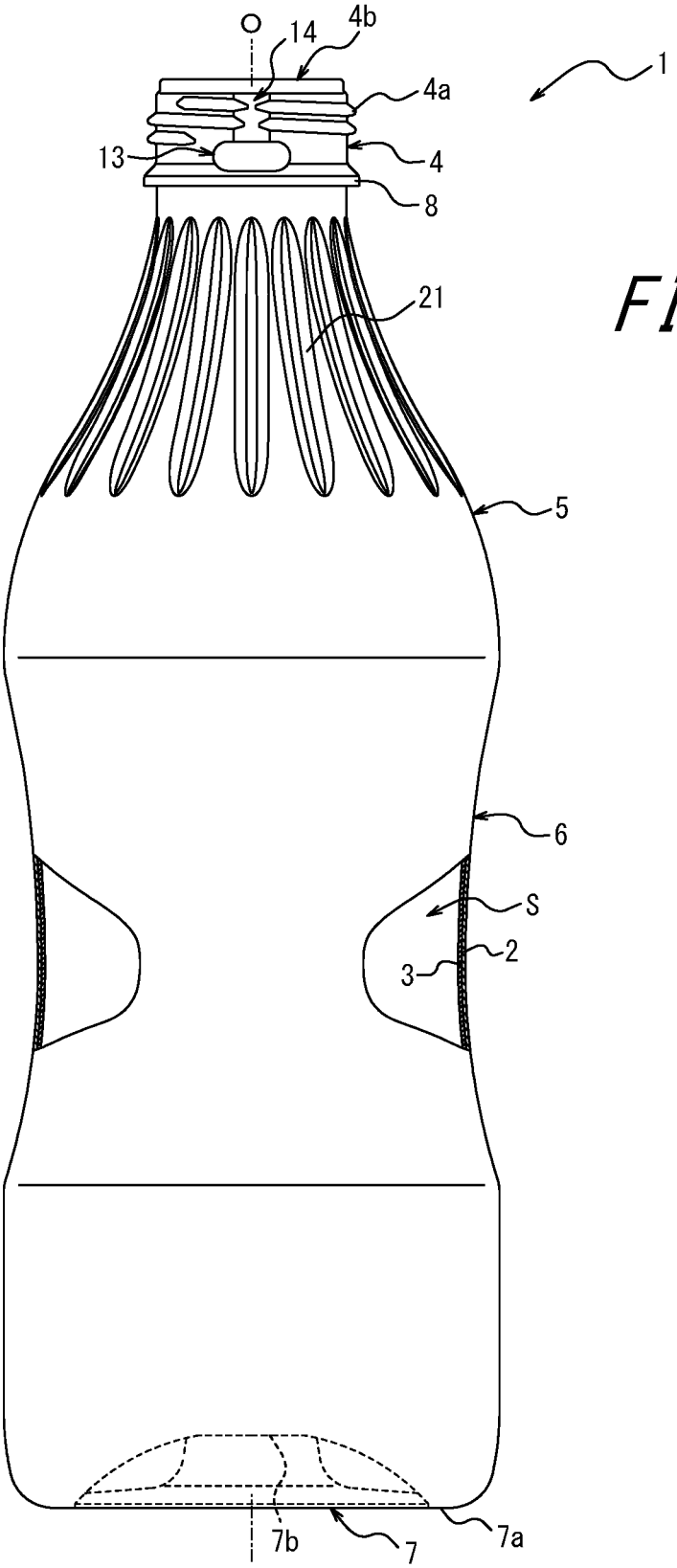
FIG. 1 is a partial sectional side view of a synthetic resin container according to an embodiment of the present disclosure.

As illustrated in FIG. 1, a synthetic resin container 1 (hereinafter referred to also as a container 1) according to this embodiment has an outer layer body 2 and an inner layer body 3 disposed inside the outer layer body 2, and is formed by biaxial stretching blow molding. In this embodiment, the container 1 is configured as a delamination container having a double container structure including the outer layer body 2 and the inner layer body 3.

Figure 2:
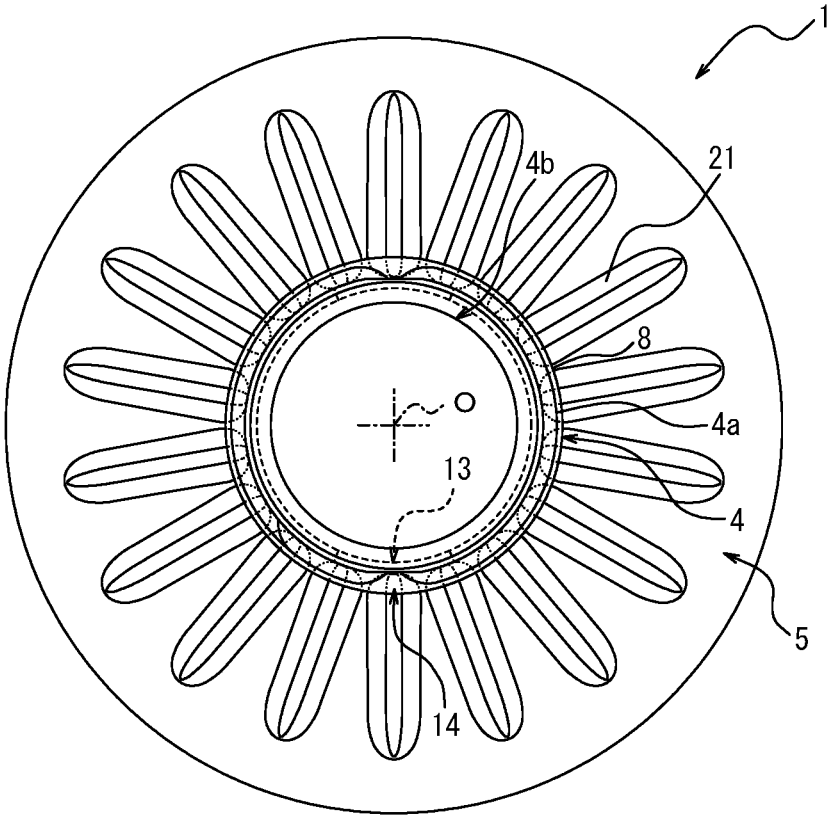
FIG. 2 is a top view of the synthetic resin container illustrated in FIG. 1.

As illustrated in FIGS. 1 and 2, the container 1 has a substantially cylindrical mouth portion 4, a shoulder portion 5 being continuous with a lower end of the mouth portion 4 and having a diameter gradually increasing downward, a body portion 6 being continuous with a lower end of the shoulder portion 5, and a bottom portion 7 configured to close a lower end of the body portion 6. Herein the up-down direction means a direction along a central axis line O of the mouth portion 4, the up direction means a direction from the bottom portion 7 to the mouth portion 4 (e.g. upside in FIG. 1) and the down direction means its opposite direction. Further, a longitudinal section means a section of a plane including the central axis line O, and a cross section means a section of a plane vertical to the central axis line O.

The mouth portion 4 has a male thread 4*a* configured to screw a spout cap. However, the mouth portion 4 may have, instead of the male thread 4*a*, a convex portion of an annular shape and the like that can be engaged with a spout cap by plugging in an undercut manner. Under the mouth portion 4 is provided with an annular neck ring 8. It is to be noted that the shape of the neck ring 8 can be appropriately changed. The mouth portion 4 may not be provided with the neck ring 8. The mouth portion 4 has an outside air introduction port 13 configured to introduce outside air between the outer layer body 3 and the inner layer body 2. The detailed configuration of the outside air introduction port 13 will be described later.

The shoulder portion 5 has a substantial conical shape that is concentric with the central axis line O of the mouth portion 4 and has a curved shape having an inflection point where the upper side is concave and the lower side is convex in the longitudinal section.

The body portion 6 has a cylindrical shape that is concentric with the central axis line O of the mouth portion 4, in which a portion extending from an intermediate portion to an upper end portion in the up-down direction is narrowed. However, the shape of the body portion 6 can be appropriately changed. For example, the body portion 6 may have a cylindrical shape having no narrow portion. The body portion 6 may also have a groove-shaped annular rib extending in the circumferential direction.

The bottom portion 7 has an annular grounding portion 7*a* concentric with the central axis line O of the mouth portion 4 and a bottom panel 7*b* located inside the grounding portion 7*a*. However, the shape of the bottom portion 7 can be appropriately changed.

In this embodiment, the outer layer body 2 is formed of polyethylene terephthalate (PET). Further, the outer layer body 2 forms the outer shell of the container 1, and a portion thereof forming the body portion 6 has a flexibility so as to be deformable by squeezing (pressing) operation and a restorability so as to be restorable by elastic force after deformation. It is to be noted that, when a container with a pump is configured by the container 1, the outer layer body 2 may not have such flexibility and restorability. Synthetic resin materials forming the outer layer body 2 are not limited to PET, and may be olefin-based resins such as polypropylene (PP) and polyethylene (PE), for example. The outer layer body 2 is not limited to a single layer structure, and may have a multi-layer structure that can improve barrier properties and the like.

In this embodiment, the inner layer body 3 is formed of PET. Further, the inner layer body 3 is formed in a bag shape with a thickness smaller than that of the outer layer body 2. A storage space S being continuous with an upper end opening 4*b* of the mouth portion 4 is formed inside the inner layer body 3. A storage space S can contain foods such as food seasonings like soy source or beverages, cosmetics such as lotion, toiletries such as shampoo, rinse or liquid soap and the like as contents. It is to be noted that the contents are not limited to foods, cosmetics or toiletries. The synthetic resin materials forming the inner layer body 3 are not limited to PET, and may be nylon or ethylene vinyl alcohol copolymer resin (EVOH) and the like. Further, the inner layer body 3 is not limited to those having a single layer structure, and may be those having a multi-layer structure that can improve barrier properties/or resistance to contents and the like.

In this embodiment, synthetic resin materials forming the outer layer body 2 and the inner layer body 3 are biaxially stretchable PET. Examples of such biaxially stretchable PET include homo PET, and the like. However, other PET such as isophthalic acid (IPA) modified PET or CHDM modified PET may be used. Further, the PET forming the outer layer body 2 and the PET forming the inner layer body 3 may be different from each other.

Figure 3:
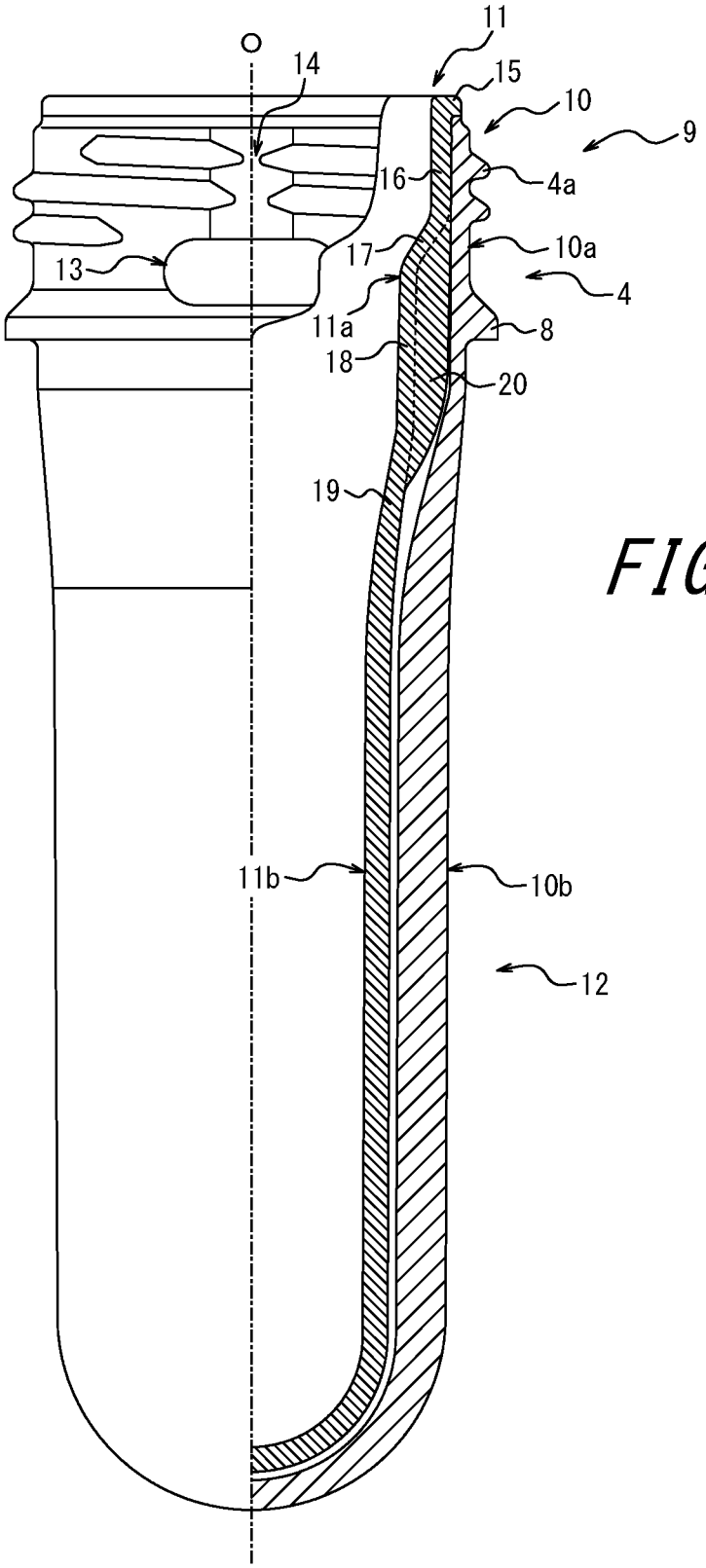
FIG. 3 is a partial sectional side view of a preform before molded into the synthetic resin container illustrated in FIG. 1.

The container 1 is formed by biaxial stretching blow molding the preform 9 illustrated in FIG. 3. The preform 9 has an outer body 10 forming the outer layer body 2 and an inner body 11 forming the inner layer body 3. In this embodiment, the preform 9 has a double preform structure including the outer body 10 and the inner body 11. Further, since the preform 9 is not substantially stretched during the biaxial stretching blow molding, it has a mouth portion 4 configured substantially in the same manner as the mouth portion 4 of the container 1. A preform body portion 12 of a bottomed cylindrical shape (test tube shape) is connected below the mouth portion 4.

The outer body 10 has a cylindrical outer mouth portion 10*a* forming the mouth portion 4. The outer periphery of the outer mouth portion 10*a* is provided with a male thread 4*a* and a neck ring 8. Further, the outer mouth portion 10*a* is provided with an outside air introduction port 13 forming a horizontal through hole at a portion between the male thread 4*a* and the neck ring 8. In this embodiment, at the outer mouth portion 10*a*, the outside air introduction port 13 is provided to each of two portions across the central axis line O. However, the number, the arrangement and the shape of the outside air introduction port 13 may be appropriately changed. The male thread 4*a* has a notch 14 immediately above the outside air introduction port 13, and through the notch 14, the outside air inlet provided at the spout cap is communicated with the outside air introduction port 13. However, the male thread 4*a* may not have such notch 14.

Under the outer mouth portion 10*a* is continuous with the outer body portion 10*b* that forms the preform body portion 12. The outer body portion 10*b* has an upper portion having an outer diameter gradually decreasing downward and a thickness gradually increasing, a cylindrical intermediate portion having a thickness being substantially constant in the up-down direction and a hemispherical bottom portion configured to close the lower end of the intermediate portion. However, the shape of the outer body portion 10*b* may be appropriately changed.

The inner body 11 has a stepped cylindrical inner mouth portion 11*a* forming the mouth portion 4. The inner mouth portion 11*a* has an annular flange 15 placed on the upper end of the outer mouth portion 10*a*, a cylindrical upper tube 16 drooping from an inner peripheral edge of the flange 15 and being in contact with an inner surface of the outer mouth portion 10*a*, a conical inclined tube 17 having a diameter decreasing downward from the lower end of the upper tube 16, and a portion (excluding a lower portion) of a cylindrical lower tube 18 drooping from a lower end of the inclined tube 17. The upper end of the inclined tube 17 is located above the upper end of a pair of outside air introduction ports 13.

An inner body portion 11*b* forming the preform body portion 12 is continuous with under the inner mouth portion 11*a*. The inner body portion 11*b* has an upper portion including a lower portion of a lower tube 18 and an inclined portion 19 having an outer diameter gradually decreasing downward from the lower portion and a gradually increasing thickness, a cylindrical intermediate portion having a thickness being substantially constant in the up-down direction, and a hemispherical bottom portion configured to close the lower end of the intermediate portion. However, the shape of the inner body portion 11*b* can be appropriately changed depending on the shape of the outer body portion 10*b*.

The inner body 11 has a convex piece 20 extending from the upper end of the inclined tube 17 to the upper portion of the inclined portion 19 along the up-down direction. Three convex pieces 20 are provided on both sides of the axis line passing through both of a pair of outside air introduction ports 13, and are configured to maintain an excellent space for ventilation between the outer layer body 2 and the inner layer body 3 around or below the outside air introduction port 13 even after the biaxial stretching blow molding. However, the number, the arrangement and the shape of the convex piece 20 may be appropriately changed. The convex piece 20 may not be provided to the inner body 11.

Such preform 9 can be molded into the container 1 by biaxial stretching blow molding in which an axial stretching by a stretching rod and a circumferential stretching by pressurized air (or liquid as contents) are performed. The container 1 formed in the above described manner has, on the shoulder portion 5 thereof, at least one shoulder rib 21 formed by conforming to a shape of a cavity of a mold for blow molding.

As illustrated in FIGS. 1 and 2, in this embodiment, the container 1 has 18 shoulder ribs 21 arranged at equal intervals in the circumferential direction of the central axis line O. However, the number and the arrangement of the shoulder rib 21 can be appropriately changed. Each shoulder rib 21 has a concave shape and extends from the mouth portion 4 side to the body portion 6 side. Further, each shoulder rib 21 extends in the radial direction in a top plan view. Moreover, each shoulder rib 21 has a U-shaped cross-sectional shape whose width gradually narrows inward in the radial direction of the central axis line O in the cross section over substantially the entire length. Therefore, in each shoulder rib 21, the inner layer body 3 can be easily separated from the outer layer body 2. Further, since the shoulder rib 21 is provided, after the inner layer body 3 is separated from the outer layer body 2, the inner layer body 3 is difficult to adhere to the outer layer body 2. In this manner, an air duct can be stably secured between the inner layer body 3 and the outer layer body 2.

Further, in this embodiment, the shoulder portion 5 is continuous with the lower end of the mouth portion 4. Thus, as compared with the case where the shoulder portion 5 is continuous with the lower end of an annular step portion whose diameter increases in a stepwise manner from the lower end of the mouth portion 4, for example, it is easier to secure an air duct between the outside air introduction port 13 and the body portion 6. However, it is sufficient that the shoulder portion 5 is located below the mouth portion 4, and is not limited to be configured such that it is continuous with the lower end of the mouth portion 4.

Further, in this embodiment, the shoulder portion 5 has a curved shape having an inflection point where the upper side is concave and the lower side is convex in the longitudinal section. Thus, as compared with the case where the shoulder portion 5 has a curved shape in which the whole is convex in the longitudinal section, for example, it is easier to secure an air duct between the outside air introduction port 13 and the body portion 6. However, it is sufficient that a diameter of the shoulder portion 5 gradually increases downward, and the shape thereof can be appropriately changed.

Figure 4:
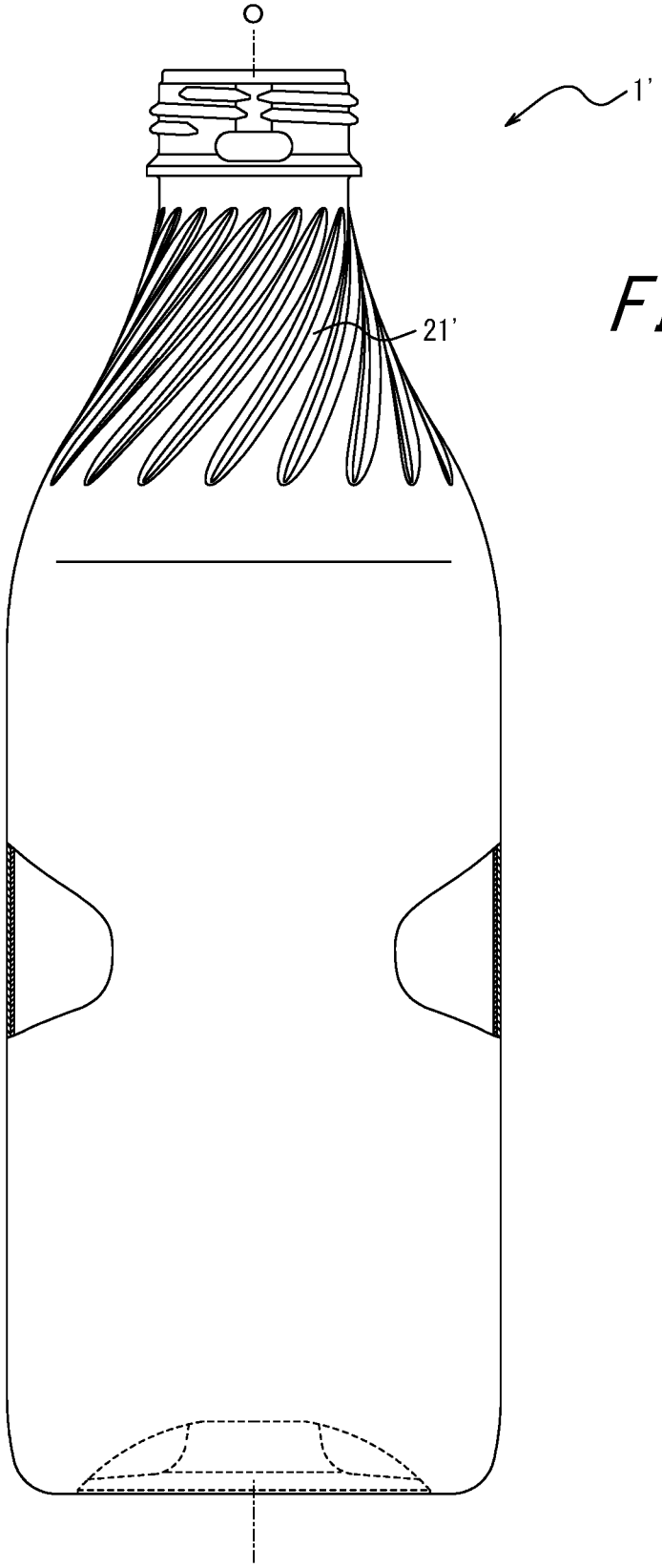
FIG. 4 is a partial sectional side view of a variation of the synthetic resin container illustrated in FIG. 1.
Figure 5:
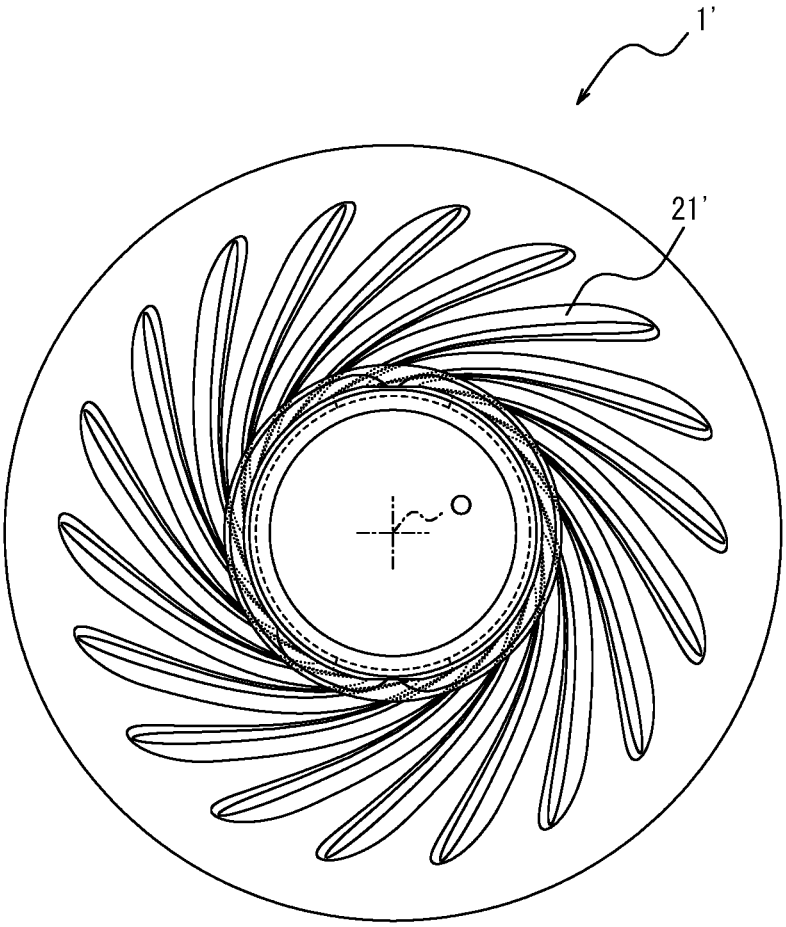
FIG. 5 is a top view of the synthetic resin container illustrated in FIG. 4.

Further, in this embodiment, at least one shoulder rib 21 extends along the radial direction of the shoulder portion 5 in a top plan view. Thus an air duct extending from the outside air introduction port 13 to the body portion 6 can be shortened to allow the outside air to be smoothly introduced. However, the shape of at least one shoulder rib 21 is not limited to the above described shape, and the at least one shoulder rib 21 may extend in a direction inclined with respect to the radial direction of the shoulder portion 5 in a top plan view, or may have a curved or bent shape in a top plan view. For example, as a variation of this embodiment, a synthetic resin container 1' may have 18 shoulder ribs 21' each extending in a direction inclined with respect to the radial direction of the shoulder portion 5 and having a curved shape in a top plan view as illustrated in FIGS. 4 and 5.

The above explanation merely describes an embodiment of the present disclosure, and is not intended to limit the scope of the claims. The above described embodiment can be modified in various manners as described below, for example, on the basis of the basic matters of the present disclosure.

In the above described embodiment, the mouth portion 4, the shoulder portion 5 and the body portion 6 of the container 1 form a circular tubular shape in the cross section. However, it is not limited thereto, and it may have a polygonal or elliptical tubular shape, for example, in the cross section.

Further, in the above described embodiment, although the outside air introduction port 13 is a through hole that passes through a portion that forms the mouth portion 4 of the outer layer body 2 (outer mouth portion 10*a*), it is not limited thereto, and it may be formed between a portion forming the mouth portion 4 of the outer layer body 2 (outer mouth portion 10*a*) and a portion forming the mouth portion 4 of the inner layer body 3 (inner mouth portion 11*a*). For example, the outside air introduction port 13 may be configured by a concave groove provided on the lower surface of the flange 15 of the inner mouth portion 11*a* and the outer peripheral surface of the upper tube 16 so as to be continuous from the outer peripheral edge of the flange 15 to the lower end of the upper tube 16 and/or by a concave groove provided on the upper end surface of the outer mouth portion 10*a* and the inner peripheral surface of the outer mouth portion 10*a* so as to be continuous from the outer peripheral edge on the upper end surface of the outer mouth portion 10*a* to a position beyond the lower end of the upper tube 16.

In the above described embodiment, at least one shoulder rib 21 forms a concave shape, but is not limited thereto, and may form a convex shape.

REFERENCE SIGNS LIST

1, 1' Synthetic resin container
2 Outer layer body
3 Inner layer body
4 Mouth portion
4*a* Male thread
5 Shoulder portion
6 Body portion
7 Bottom portion
7*a* Grounding portion

7*b* Bottom panel
8 Neck ring
9 Preform
10 Outer body
10*a* Outer mouth portion
10*b* Outer body portion
11 Inner body
11*a* Inner mouth portion
11*b* Inner body portion
12 Preform body portion
13 Outside air introduction port
14 Notch
15 Flange
16 Upper tube
17 Inclined tube
18 Lower tube
19 Inclined portion
20 Convex piece
21, 21' Shoulder rib
O Central axis line
S Storage space

The invention claimed is:

1. A synthetic resin container including an outer layer body and an inner layer body disposed inside the outer layer body and formed by biaxial stretching blow molding, the synthetic resin container comprising:

a cylindrical mouth portion formed by a cylindrical outer mouth portion and a stepped cylindrical inner mouth portion, the stepped cylindrical inner mouth portion including:

a flange located at an upper end of the outer mouth portion, a cylindrical upper tube extending downward from an inner peripheral edge of the flange and contacting an inner surface of the outer mouth portion, a conical inclined tube extending downward from a lower end of the upper tube, the conical inclined tube having a decreasing diameter in a downward direction of the synthetic resin container, a cylindrical lower tube extending downward from a lower end of the conical inclined tube, a convex piece extending from an upper end of the conical inclined tube along an axial direction of the synthetic resin container, and an outside air introduction port configured to introduce outside air between the outer layer body and the inner layer body;

a shoulder portion located below the mouth portion and having an increasing diameter along a downward direction of the synthetic resin container, the shoulder portion having at least one shoulder rib configured to form a concave shape or a convex shape and extend from a mouth portion side to a body portion side, a body portion extending continuous from a lower end of the shoulder portion; and a bottom portion configured to close a lower end of the body portion, wherein:

the convex piece protrudes toward the outer layer body to maintain a space for ventilation between the outer layer body and the inner layer body, the convex piece being located below the outside air introduction port.

2. The synthetic resin container according to claim 1, wherein a synthetic resin material forming the outer layer body and the inner layer body is polyethylene terephthalate.

3. The synthetic resin container according to claim 2, wherein the shoulder portion forms a curved shape having an inflection point, the shoulder portion having, along a longitudinal section, an upper side relative to the inflection point that is concave and a lower side relative to the inflection point that is convex.

4. The synthetic resin container according to claim 2, wherein the at least one shoulder rib extends along a radial direction of the shoulder portion in a top plan view.

5. The synthetic resin container according to claim 4, wherein the shoulder portion forms a curved shape having an inflection point, the shoulder portion having, along a longitudinal section, an upper side relative to the inflection point that is concave and a lower side relative to the inflection point that is convex.

6. The synthetic resin container according to claim 1, wherein the at least one shoulder rib extends along a radial direction of the shoulder portion in a top plan view.

7. The synthetic resin container according to claim 6, wherein the shoulder portion forms a curved shape having an inflection point, the shoulder portion having, along a longitudinal section, an upper side relative to the inflection point that is concave and a lower side relative to the inflection point that is convex.

8. The synthetic resin container according to claim 1, wherein the shoulder portion forms a curved shape having an inflection point, the shoulder portion having, along a longitudinal section, an upper side relative to the inflection point that is concave and a lower side relative to the inflection point that is convex.

* * * * *